US008659443B2

(12) United States Patent
Mandel

(10) Patent No.: US 8,659,443 B2
(45) Date of Patent: Feb. 25, 2014

(54) TREATMENT AREA ZONING SYSTEM

(76) Inventor: Bruce Mandel, Short Hills, NJ (US)

( * ) Notice: Subject to any disclaimer, the term of this patent is extended or adjusted under 35 U.S.C. 154(b) by 550 days.

(21) Appl. No.: 12/912,998

(22) Filed: Oct. 27, 2010

(65) Prior Publication Data

US 2011/0095902 A1 Apr. 28, 2011

Related U.S. Application Data

(60) Provisional application No. 61/280,015, filed on Oct. 28, 2009.

(51) Int. Cl.
*G08B 5/00* (2006.01)
*G08B 23/00* (2006.01)

(52) U.S. Cl.
USPC ..... 340/815.65; 340/815.4; 340/908; 340/321; 340/332; 362/162

(58) Field of Classification Search
USPC ..... 340/815.4, 815.65, 907, 908, 908.1, 340/321, 331, 332; 362/413, 418, 162; 116/63 R, 63 P
See application file for complete search history.

(56) References Cited

U.S. PATENT DOCUMENTS

| | | | | |
|---|---|---|---|---|
| 2,838,744 | A | 6/1958 | De Wald | |
| 3,415,476 | A | 12/1968 | McDermott | |
| 4,430,638 | A | 2/1984 | Parker | |
| 5,457,449 | A * | 10/1995 | Kuning et al. | 340/908 |
| 5,677,669 | A | 10/1997 | Walkley, IV et al. | |
| 5,684,452 | A * | 11/1997 | Wang | 340/321 |
| 6,104,313 | A * | 8/2000 | Boyd, II | 340/908.1 |
| 6,259,373 | B1 | 7/2001 | Ghahramani | |
| 6,568,546 | B1 * | 5/2003 | Huang | 211/205 |
| 6,808,291 | B1 | 10/2004 | Aylward et al. | |
| 6,854,862 | B1 | 2/2005 | Hopf | |
| 7,233,259 | B2 | 6/2007 | Gibson | |
| 7,391,340 | B2 | 6/2008 | Malhomme | |
| 8,319,662 | B1 * | 11/2012 | Bontemps et al. | 340/908 |
| 2003/0090904 | A1 | 5/2003 | Ching | |
| 2005/0282665 | A1 * | 12/2005 | Tarng et al. | 473/465 |

* cited by examiner

*Primary Examiner* — Anh V La
(74) *Attorney, Agent, or Firm* — Gearhart Law, LLC

(57) ABSTRACT

A treatment area marker device and method for using the treatment area marker in setting up a triage facility for patient care. The device and the method may be particularly useful during an emergency or crisis situation. The treatment area marker is an article of manufacture that includes a light source that is capable of generating different colors of light. The bottom end of the treatment area marker has the means for keeping the device in a substantially upright position. The method of triage includes establishing one or more treatment areas, and erecting one or more treatment area markers to identify the treatment area.

19 Claims, 4 Drawing Sheets

TREATMENT AREA ZONING SYSTEM

CLAIM OF PRIORITY

This application claims priority to U.S. Ser. No. 61/280,015 filed on Oct. 28, 2009, the contents of which are fully incorporated herein by reference.

FIELD OF THE INVENTION

The invention relates to equipment and methods used by disaster rescue personnel, emergency medical services personnel and the like.

BACKGROUND OF THE INVENTION

The present invention relates equipment and methods used to perform triage in the event of a mass casualty incident. Natural and man-made disasters are unfortunately a common occurrence. Examples of such incidents include but are not limited to natural disasters such as hurricanes and forest fires, train wrecks, multi-vehicle highway accidents, airplane crashes and terrorist attacks. In the past, certain responses by Emergency Medical Services (EMS) have demonstrated that EMS systems may fail due to poor communication, inefficient uses of available systems and conflicting codes, lack of a common, flexible, predesigned structure, and lack of predefined methods to integrate inter-agency requirements. This invention provides a systematic and efficient improvement of the equipment and methods used to mark a triage area, and which can contribute to creating a nation-wide, uniform response effort.

DESCRIPTION OF THE RELATED ART

U.S. Pat. No. 2,838,744 describes a portable emergency signal and traffic control apparatus.

U.S. Pat. No. 3,415,476 describes a collapsible stand mounted light for warning on coming traffic of police activity.

U.S. Pat. No. 4,430,638 teaches a warning and distress signal light for a disabled vehicle which has a vertical cylindrical body having at its lower end a rubber suction cup and three folding legs with magnetic feet attached thereto for supporting the body. Four illuminating arms spelling out the words CAUTION, AUTO, ACCIDENT and TROUBLE.

U.S. Pat. No. 5,677,669 teaches the Audio Illuminator that is an integrated system providing directed lighting and a public address type amplification and loudspeaker capability, under control from a remote location. The system includes a searchlight and one or more directional, high-power loudspeakers. An audio amplifier supplies drive signals to the loudspeakers in response to audio input signals received from the remote control. The system includes a power junction box for supplying power to the amplifier and the searchlight and carrying signals to and from the various components. The system may derive power from a small portable diesel generator. A gimbal mount supports the searchlight for two-directional movement (horizontal rotation and vertical tilt angle rotation) and supports the one or more loudspeakers for movement with the searchlight in at least one of the two directions. Drive motors provide two-dimensional automatic positioning in response to signals from the remote control unit. The speakers are highly directional, and the motion of the speakers together with the searchlight enables aiming both the sound and the light at a selected target. The remote control unit includes or provides a connection to a microphone, and the remote control supplies signals from the microphone to the audio amplifier for audio output from the loudspeakers.

U.S. Pat. No. 6,259,373 describes a multiple hazard marker system consisting of at least one multiple hazard marker, a deployment vehicle, a deployment surface and a deployment device for deploying the multiple hazard marker. The multiple hazard marker comprises a ground engaging portion, an upper portion and a central portion. The multiple hazard marker will remain erect when deployed and includes a visible marker for marking a position upon a field where deployed. The multiple hazard marker further has collapsible elements that expand upon deployment, a signaling device, a receiver for activating the signaling device and transmitter associated with the signaling device. The deployment device for deploying the multiple hazard marker collapses and retains the multiple hazard marker in the deployment device until a releasing mechanism releases the multiple hazard marker from the deployment device at deployment.

U.S. Pat. No. 6,808,291 discloses a hazard/safety warning device which has a lamp member and a base, the lamp member being able to be used with and without the base. The base has a self-righting feature so that when the lamp is in the base, the lamp will rock to the vertical position. The lamp is activated by rotating a fresnel lens about its longitudinal axis relative to the body. A bonnet connection allows the lamp member to be attached to the base. The base has external ribs for stability of operation, and the body of the lamp has at least two handles. The filament of the globe is located at the optical centre of lens, with the lens being designed to have a generally vertical directed beam along the longitudinal axis, and an annular, transverse beam generally horizontal. The remainder of the lens provides a diffused light.

U.S. Pat. No. 6,854,862 teaches an adjustable light including a knock down base frame, a vertical frame, which supports a boom arm, which in turn supports a light fixture. The light fixture is supported on the boom arm by a fixture mount that provides five degrees of freedom of movement of the light fixture relative to the boom arm. The boom arm is pivotally mounted to the vertically adjustable frame, thereby providing two additional degrees of freedom to the light fixture relative to the ground. The base frame includes two legs that are movably secured to the base frame. The base frame and the legs include wheels, the wheel supports being movably mounted to the frame and legs to allow for free movement on any planar surface on which the adjustable light is supported. The boom arm and the shield of the light fixture include bumpers to prevent damage by inadvertent contact to a surface. The lens in the fixture is replaceable to allow the user to use different lenses as dictated by the job requirements. A typical lens includes a substantially opaque section approximately one inch wide that is positioned in the center of the lens and runs the length of the lens.

U.S. Pat. No. 7,233,259 consists of a traffic control sign assembly that comprises a sign having a central opening. Control consoles are positioned on opposite sides of the sign in centered relation to the central opening and are connected to one another and to the sign. A two-sided bread board type LED light panel is mounted in the central opening within the control consoles with light-diffusing panels mounted over the LED light panel. A power source is connected to the LED light panel. A first silk screen with legend "STOP" and a second silk screen with legend "STOP" or "SLOW" is located on the back of each of the light diffusing panels in alignment with the LED light panel. Switch means for turning said power source "ON" in a holding or a flashing mode or "OFF" is provided. A handle assembly is secured to the sign.

U.S. Pat. No. 7,391,340 relates to a portable helicopter landing area and to the use method thereof. The inventive device comprises two cases (1, 2) which can be carried by the person on the ground (X) and which are intended to be disposed on the selected surface or area (H). Moreover, two units (A, B) can be removed from the aforementioned two cases respectively. The visual positioning unit (A) comprises: a light which produces four successive white flashes (7) and which is visible from a distance of at least forty kilometers by an aircraft pilot, and a high-frequency current generator unit. The lighting unit (B) comprises: (i) at least five marker lights (16*a* to 16*e*) which are disposed in the form of a Y on the ground, thereby creating five white points on the ground which turn blue when the pilot reaches the vertical above the selected landing area or surface (H); and (ii) a kit for the assembly of an illuminated wind cone which provides information relating to the wind at the aforementioned selected landing area or surface (H). The invention is suitable for emergency operations requiring the intervention of at least one airborne team and, in particular, a heliborne team.

US Patent Application No. 20030090904 teaches a work light stand, with light installed thereon, comprising an adjustable lever, with its length fixable by a fastening device; and supporting legs, hinged to the adjustable lever and maintaining said work light stand in the upright standing position. The fastening device is of a notched ring structure, where a body core pierces across the notch; and a working lever, hinged to one end of the body core, can be tightened in the notch to tighten or loosen the fastener which in turn fastens or releases between the first lever and the second Various implements are known in the art, but fail to address all the problems solved by the invention described herein. One embodiment of this invention is illustrated in the accompanying drawings and will be described in more detail herein below.

SUMMARY OF THE INVENTION

The invention relates to a treatment area marker and a method of using the treatment area marker in performing emergency medical triage. The treatment area marker includes a light source capable of generating different colors of light. The treatment area marker also includes a substantially vertical stand that may have a bottom end and a top end. In a preferred embodiment, the bottom end of the treatment area marker may include a means for keeping the treatment area marker in a substantially upright position. The method of triage includes establishing one or more treatment areas. At each established treatment area, one or more treatment area markers may then be erecting and serve to identify the nature of each of the treatment areas.

An object of this invention is to designate locations that patients can be brought to and treated based on the severity of their injuries. Treatment areas are designated by a color-coding scheme. Another object of this invention is to improve the efficiency of triage. This is achieved by providing equipment that is easy to setup and standard procedures. A single person can set up a set of treatment area markers within three minutes.

DESCRIPTION OF THE PREFERRED EMBODIMENTS

Figure 1:
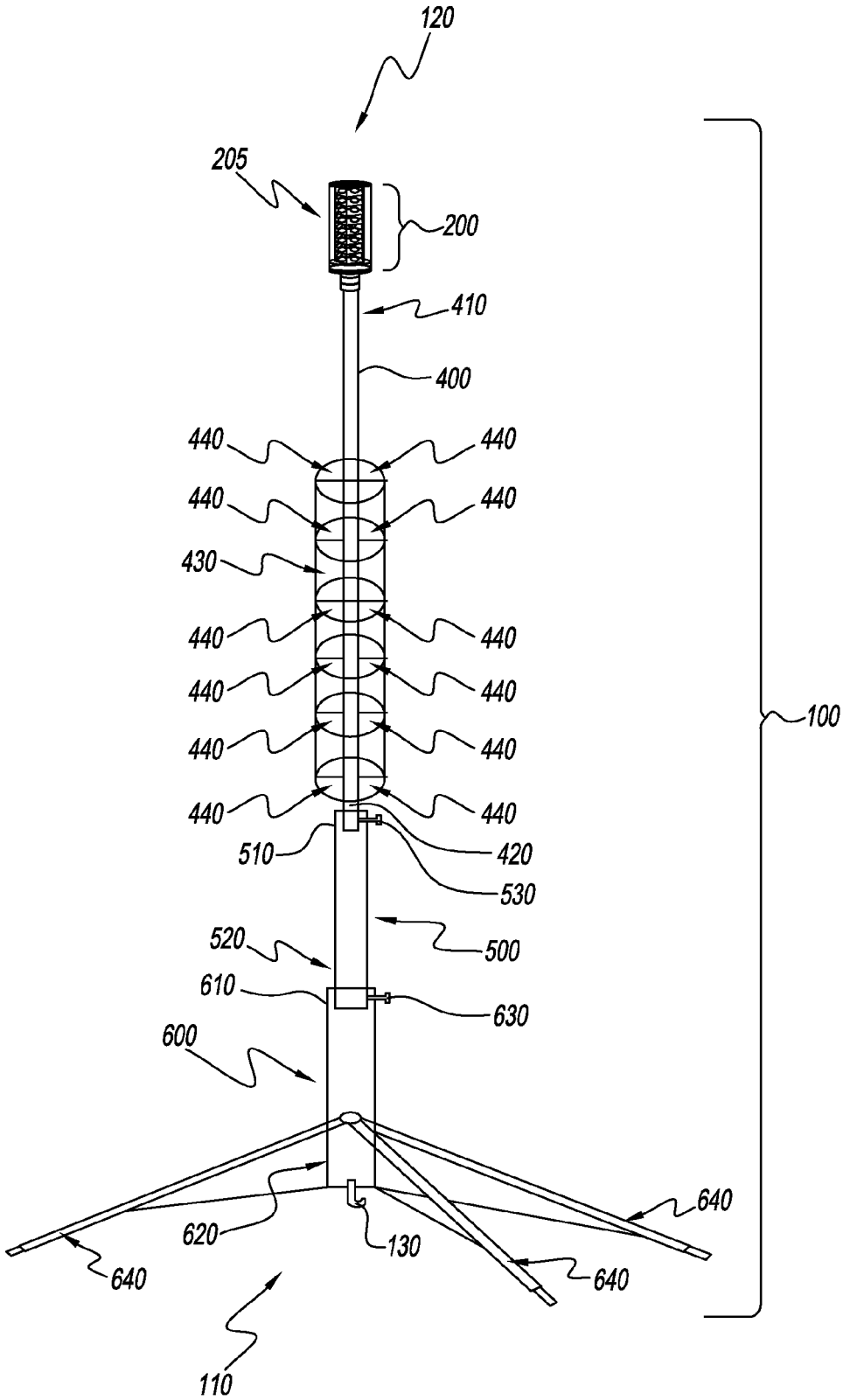
FIG. 1 shows a preferred embodiment of the invention as a treatment area marker with the vertical stand and its elements.

The preferred embodiments of the present invention will now be described with reference to the drawings. Identical elements in the various figures are identified with the same reference numerals.

The invention is directed to devices and methods for setting up triage and facilitating patient care during an emergency or crisis situation. The invention has an article of manufacture and a method of triage. FIG. 1 shows a preferred embodiment of the article of manufacture as a treatment area marker 10. The treatment area marker has a vertical stand 100. The vertical stand 100 is shown with: a bottom end 110, a top end 120, a light source assembly 200, lamppost 400, a post extension 500 and a post 600. The lamppost 400 has lamppost first end 410, lamppost second end 420 and hanger arms 440. A flag 430 is shown attached to the hanger arms 440. The flag 430 may or may not have any coloration of marking or may be opaque, transparent or translucent. The post extension 500 is shown with post extension first end 510, post extension second end 520 and post extension fastener 530. The post 600 is shown with: post first end 610, post second end 620, post fastener 630 and legs 640. Many configurations of the legs are possible including but not limited to: legs 640 may collapse or fold up so they are parallel to the post 600; legs 640 may screw into post 600; legs 640 may snap into post 600. Furthermore, legs 640 may be telescopic, or may attach using fasteners.

Lamppost second end 420 is shown connecting lamppost 400 to post extension 500 at post extension first end 510 with post extension fastener 530 securing said connection. Post extension second end 520 is shown connecting post extension 500 to post 600 at post first end 610 with post fastener 630 securing said connection. The post 600 is preferably hollow and is capable of accepting the insertion of post extensions 500 that slide within the post 600, and within each other, to create a collapsible post. The desired height of the stand 100 may be fixated with a set screw that prevents the extension posts 500 from sliding back down into the post 600. Materials that vertical stand 100 also known as the substantially vertical stand 100, lamppost 400, hanger arms 440, post extension 500, post 600 and legs 640 may be made from include but are not limited to: metal, metal alloy, plastics, wood, composites. Materials the flag 430 may be made from include but are not limited to: natural fabric, artificial fabric, metal foils, plastic foils, composite foils. Other useful materials from which to manufacture any of the components of this invention include one or more plastics and resins, including but not limited to plastic, rubber, foam, silicone, ABS, Polycarbonate, Noryl™, PVC, Polystyrene, ABS/PVC, PVC/Acrylic, Polysulfone, Acrylic, Polyethylene, Kydex™, PETG; glass, including but not limited to fiberglass, borosilicate, or quartz; wood; metals, including but not limited to iron, tin, aluminum, copper; rubber including but not limited to natural rubber, SBR, Isoprene rubber, Butadiene rubber, and Chloroprene rubber; or any combinations or composites of these materials or other materials and new materials that may be manufactured in the future. The parts to the kit 800 may be manufactured from identical or different component.

Flags 430 may be made of any color or combinations of colors. In the preferred embodiment the available flag colors are green, yellow, red and black.

The invention further provides a means of anchoring the stand. In one embodiment, the means of anchoring is a utility pack attached to the bottom end 110, having a power source and a plurality of storage compartments. The anchoring or attachment means may be a hook 130 as shown in FIG. 1. The hook 130 may be permanently affixed to the bottom end 110, or anywhere else along the stand 100, or may be removable. Alternatively, the attachment mechanism or the attachment means for the anchoring means may be anything that creates a preferably temporary but robust attachment. Therefore the attachment may be done with a carabineer clip disposed on the bottom end 110, or any other clip, bracket or male and female socket, capable of decoupling or coupling only with substantial prodding, such as but not limited to, actuation and de-actuation levers, attachment or detachment levers, or spring or manually loaded rollers or pins, wherein the springs or pins would retract only with substantial application of force.

The article of manufacture may further consist of a means for attaching a floodlight illumination to the top end 120. In another embodiment, the flood light illumination is a plurality of xenon lamps. The flood light lamps may also be made of LED lights or the light source 205 may be a plurality of multicolored lights disposed along the length of said stand. The lights making up the light source 205 may be capable of multiple strobe or pulse speeds. Any of the lights may be located anywhere on the stand including at the top, the bottom or disposed along the length of the stand. Another example of floodlight illumination, or illumination in general, is to have an upward facing light that may be seen from the sky by planes and helicopters. Such light may be strobe or search light or both, and may be used as a signaling device, guidance or communication device.

The vertical stand 100 may also consist of a set of hanger arms 440 rotationally attached anywhere along the length of the stand, and one or more colored flags 430 suspended from the hanger arms 440. The rotational attachment is preferably an attachment of a hanger arm 440 on a pivot or fastener (not shown) that is mounted along the stand 100. When the stand 100 is being setup, the hanger arms 440 will pivot outward away from the stand 100, to form a hanger for the flag 430; and will swing downward to be parallel and substantially flush with the stand 100, when the stand 100 is being collapsed or folded. The color of said flag 430 may match that of the light source 205.

One means of keeping the vertical stand 100 in a substantially upright position is composed of manufacturing a stand 100 with at least three extendable legs 640 attached along the length of the vertical stand 100. In one embodiment, the stand 100 is collapsible. In another embodiment, the stand 100 is substantially tubular. In still another embodiment, the stand 100 is made of a lightweight metal alloy. In the alternative, the stand 100 is made of lightweight polymer. The stand 100 and its components may be made of one or more combinations of these or other materials described herein.

The legs 640, hanger arms 440 and other attachments may be telescopic, hinged, snap together, screw together or be collapsibly attached and detached from other components of the invention.

Figure 2:
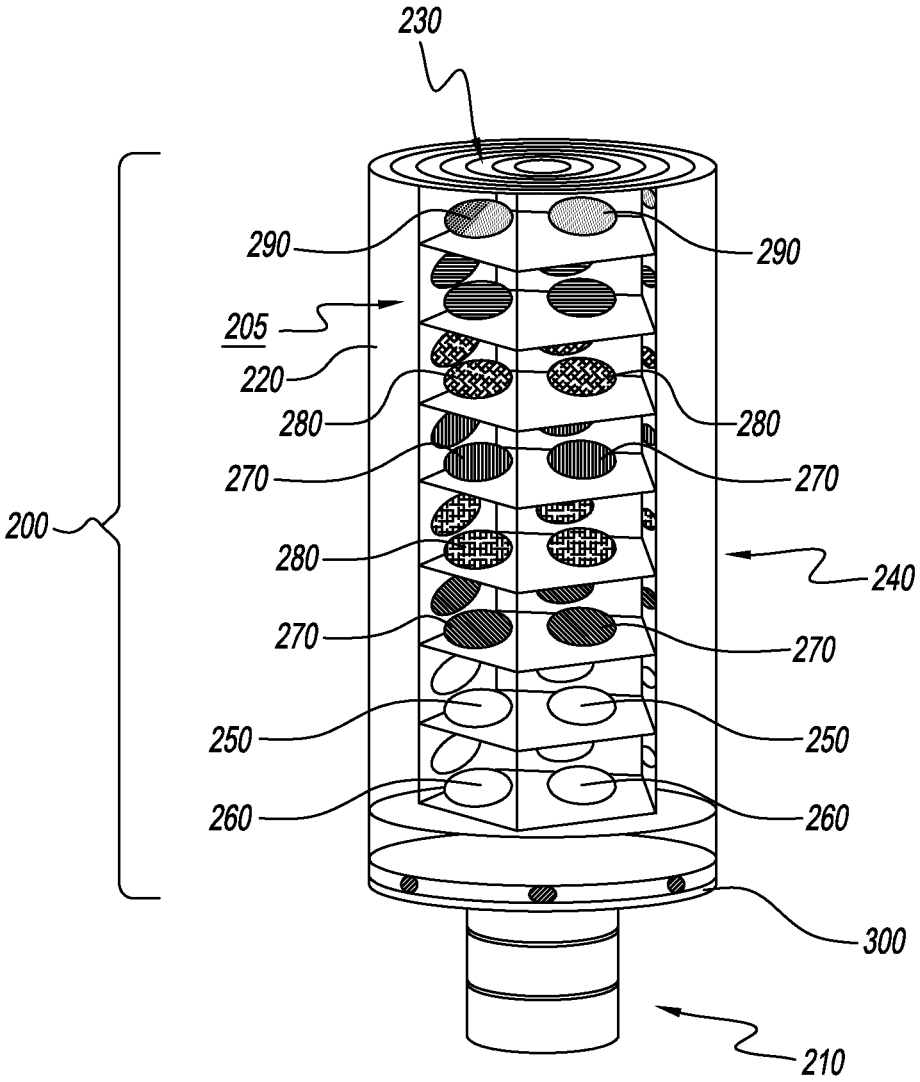
FIG. 2 shows a close-up view of a representative light source assembly of the treatment area marker.

FIG. 2 shows a close-up view of a light source assembly 200 of the treatment area marker. The light source assembly 200 is shown with a light source 205, a fitting 210, housing 220, housing top 230, translucent cover 240, flood lights 250, lasers 260, green lights 270, yellow lights 280, red lights 290 and housing bottom 300. The preferred embodiment of the light source assembly 200 is shown to be cylindrical in shape. Possible shapes for the light source assembly 200 include but are not limited to: tubular, cylinders (right circular cylinders), rectangular boxes (cuboid), right cylinders, cylinders, right prisms and prisms. Possible materials for the translucent cover include but are not limited to: glass, Plexiglas, plastic and composites. The green lights 270, yellow lights 280 and red lights 290 may be generation 3 color coded LED's that can be seen from 360 degrees from distances over a mile. The lights may be placed in any order, and any number of suitable lights may be contained with the housing. The floodlights may illuminate the treatment areas (1100, 1200, 1300 and 1400) at night. The lasers 260 may mark the treatments areas (1100, 1200, 1300 and 1400) and may be remote controlled.

Power may be electrical or by battery or by any means of power available and known to those skilled in the art. In addition, the invention may include an electrical power chord to power itself and may further provide electrical outlets for emergency patient care, or for recharging batteries or other devices necessary for emergency care. There may also be one or more solar power panels which provide power to the invention or to articles used in emergency medical services and which are known to those skilled in the art. Furthermore, there may be included a rechargeable power pack or a battery charger 860 or battery 870, allowing for storage of energy collected by any power source, including, but not limited to electrical, mechanical, wind or solar.

Figure 3:
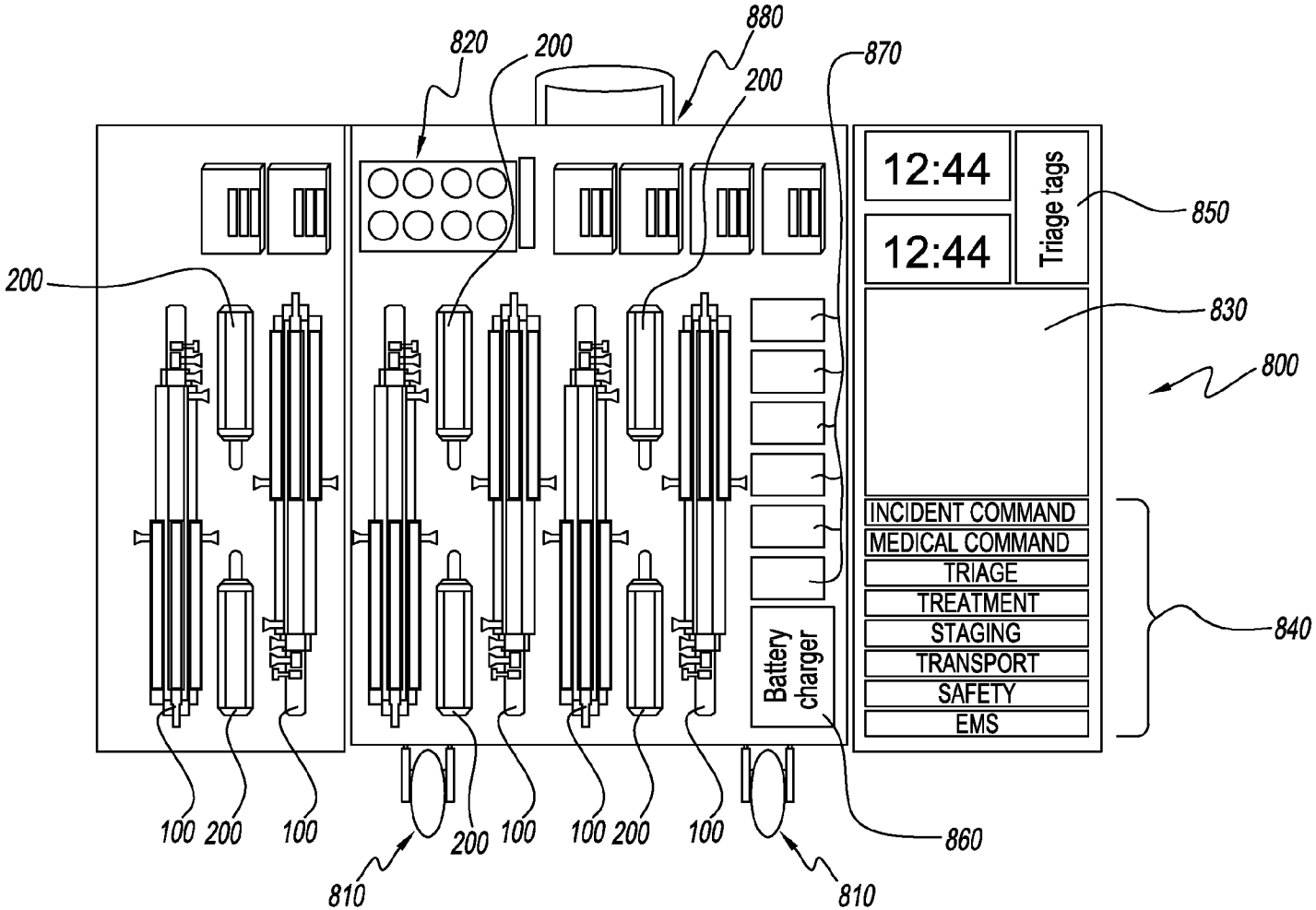
FIG. 3 shows a preferred embodiment of the invention of the treatment marker as a kit.

FIG. 3 shows a preferred embodiment of the invention as a treatment maker as a kit 800. Kit 800 is shown with wheels 810 and shown holding: vertical stands 100, lighting source assemblies 200, clip boards 830, markers 840, triage tags 850 battery charger 860, batteries 870. The kit 800 may have foam formed receptacles for each component. The stand 100, flags 430, light 200 and other accessories are disposed in the kit 800. The kit 800 further includes one or more of the following: a carrying case 880, floodlights, a plurality of power sources, reflective vests, a plurality of tags, and a means for recording emergency activities, triage tags, and tracking tags. Other accessories for the kit 800 may include one or more of the lights, flags, paper, writing utensils such as pens, pencils, markers or paints, electronic communication devices, batteries, blankets, as well as any combinations of these items and other items known by those skilled in the art. Due to extensive use lightweight materials for the carrying case 880 and for the contents of the kit 800, the kit 800, when packed and folded, may be carried by a single average person.

Figure 4:
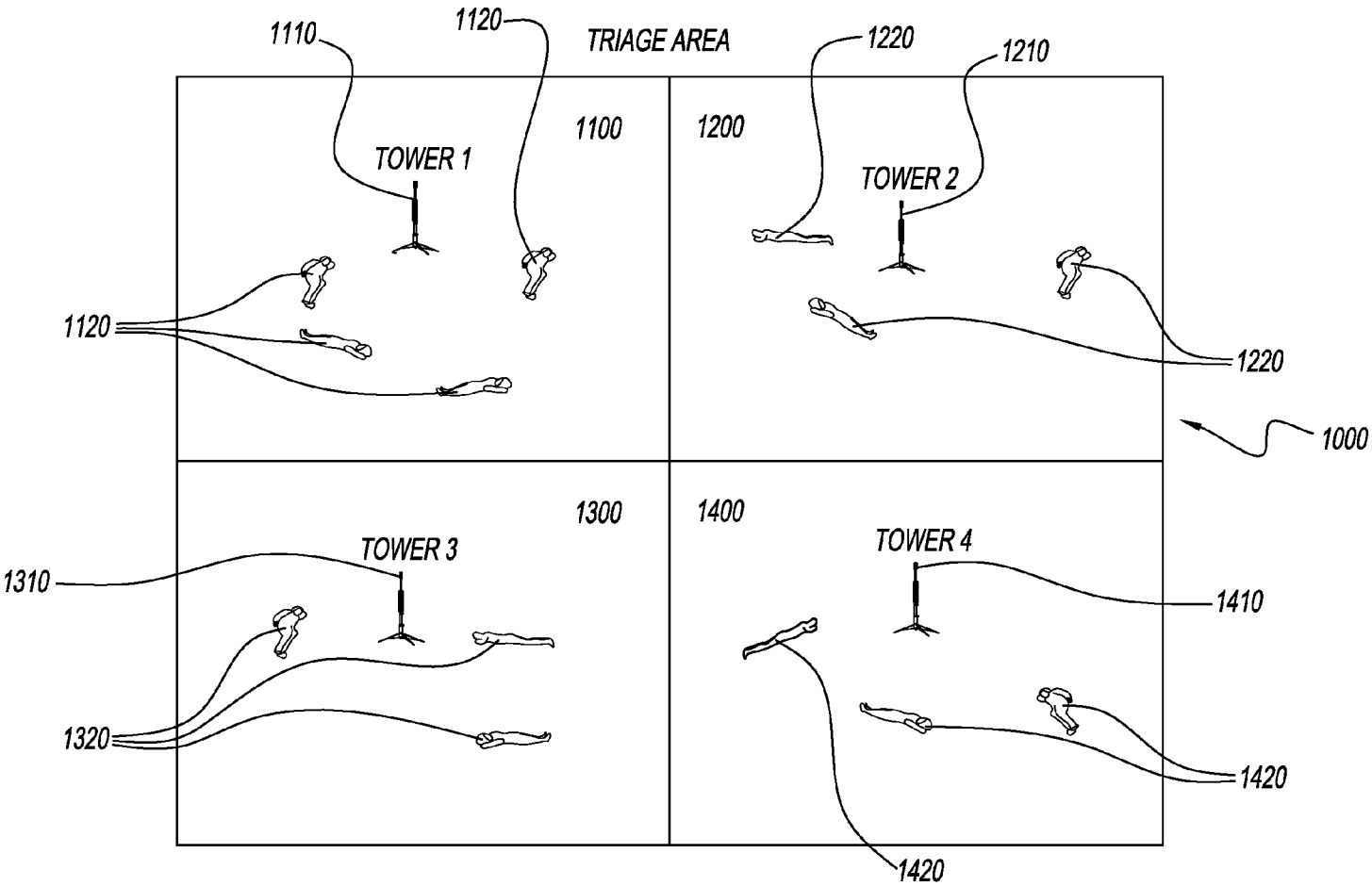
FIG. 4 shows one possible arrangement of the triage treatment area makers.

FIG. 4 shows a possible arrangement of the treatment area makers defining a triage area 1000, which is shown with treatment area 1 1100, treatment area 2 1200, treatment area 3 1300 and treatment area 4 1400. Treatment area 1 1100 is shown with treatment area 1 tower 1110 and treatment area 1 patients 1120. Treatment area 2 1200 is shown with treatment area 2 tower 1210 and treatment area 2 patients 1220. Treatment area 3 1300 is shown with treatment area 3 tower 1310 and treatment area 3 patients 1320. Treatment area 4 1400 is shown with treatment area 4 tower 1410 and treatment area 4 patients 1420. One possible color-coding scheme is represented in the following table:

TABLE I

| | Color-code | | | |
|---|---|---|---|---|
| | Green | Yellow | Red | Black |
| Treatment Area | Treatment Area 1 1100 | Treatment Area 2 1200 | Treatment Area 3 1300 | Treatment Area 4 1400 |
| Triage priority | Walking wounded | Delayed | Immediate | Morgue |

The process described in Table I includes assigning the patient a color categorization based on those injuries: green means least severe, yellow means non-life-threatening, red indicates a patient is in critical condition requiring immediate care, and black indicates the victim is deceased. The purpose of the Treatment Area is to designate locations that patients can be brought to and treated based on the severity of their injuries.

The invention is also directed to methods of treating injured persons or responding to emergency situations, for example in a disaster situation. The method of triage consists of one or more steps. A method of triage has the steps of: establishing one or more treatment areas; and erecting one or more vertical stands 100 to identify the treatment areas. Another method of triage may have the steps of assigning unique identification colors to said treatment areas; disposing a colored light on said stands; and disposing a flag 430 on said stand matching color of said colored light. Still another method of triage may have the steps of designating a plurality of tags identifying said treatment area; and of assigning said tags individual to subjects utilizing said treatment area. A further method of triage may have the steps of disposing a plurality of floodlights on said stand; and anchoring said stand in a substantially stationary position.

Further such steps include, but are not limited to (1) establishing one or more treatment areas, or secondary areas, such as, but not limited to logistical support, headquarters, security, living and food service quarters, a helipad, a parking area, a visitor and or counseling area, or any additional area needed to effectuate the present invention; (2) erecting at one or more stands to indentify the treatment area; (3) assigning unique identification colors to said treatment areas; (4) a method in which one or more colored lights are disposed on one or more stands; (5) disposing a flag 430 on the stand in which the color of the flag 430 matches the color of the colored light. Note that the color of the flag 430 may match that of the colored light 205 or it may be different or in contrast to it.

The invention uses the treatment area marker 10 as substantially described herein in order to execute the method of triage described above. The article of manufacture has a substantially vertical stand 100 have a bottom end 110; a light source 205 capable of generating different colors of light; and said bottom end 110 having means of keeping said stand in a substantially upright position. The vertical stand 100 may have an anchoring means, which may have a utility pack attached to said bottom, having a power source and a plurality of storage compartments (not shown). The vertical stand 100 may have means for attaching a floodlight to said top end 120 and said floodlight types include but are not limited to: xenon lamps, high intensity discharge (HID), sealed beam lamps and halogen lamps. The vertical stand 100 may have a set of hanger arms 440 rotationally attached along the length of said stand and a colored flag 450 suspended from said hanger arms 440 and the flag color may match the color of the light source 205. The vertical stand 100 may have three extendable legs 640 attached along the length of said stand that are the means of keeping said stand in an upright position. The extendable legs instead be an elliptical or angular base that may unfold or which may be attached to the bottom end 110 of the stand 100. Such a base would be conical with the broad area facing the supporting surface and the narrower area attached to the bottom end 110.

The light source 205 may be a plurality of LED lights dispose at the top of the vertical stand 100. The light source 205 may be a plurality of multicolored lights disposed along the length of said stand. Possible modes of construction of the vertical stand include but are not limited to: a single member, multiple collapsible sections; multiple telescoping sections (narrower sections slide in and out of wider sections), multiple detachable sections. Possible shapes for the vertical stand include but are not limited to: tubular, cylinders (right circular cylinders), rectangular boxes (cuboid), right cylinders, cylinders, right prisms and prisms. Materials that vertical stand may be manufactured from include but are not limited to: lightweight polymer, plastic, metal, metal alloy, composites and wood. The vertical stand 100, light source 205 and means for keeping said stand in a substantially upright position may be disposed in a kit 800. Said kit 800 may include a plurality of floodlights, a plurality of power sources, a plurality of reflective vests, a plurality of tags and a means of recording and tracking said tags.

Although this invention has been described with a certain degree of particularity, it is to be understood that the present disclosure has been made only by way of illustration and that numerous changes in the details of construction and arrangement of parts may be resorted to without departing from the spirit and the scope of the invention.

I claim:

1. A set of treatment area markers for use in combination to create a multitude of color-coded triage areas, each treatment area marker, comprising:

a substantially vertical stand having a bottom end and a top end;

a light source assembly capable of generating different colors of light; and said bottom end having a means of keeping said stand in a substantially upright position, wherein the light source assembly includes colored lights, flood lights and lasers;

and each of the treatment area markers is assigned an individual color for the light to color-code the triage area where the marker is placed.

2. The set of claim 1, wherein each treatment area marker further comprises a means of anchoring said stand.

3. The set of claim 2, wherein said means of anchoring is a utility pack attached to said bottom end, having a power source and a plurality of storage compartments.

4. The set of claim 1, wherein the floodlight is attached to the top end of each area marker.

5. The set of claim 1, wherein each treatment area marker further comprises a set of hanger arms rotationally attached along the length of said stand, and a colored flag suspended from said hanger arms.

6. The set of claim 5, wherein a color of said flag matches that of the light source.

7. The set of claim 1, wherein said means of keeping said stand in a substantially upright position is comprised of at least three extendable legs attached along the length of said stand.

8. The set of claim 1, wherein light source of each treatment area marker is capable of multiple strobe speeds.

9. The set of claim 1, wherein said light source of each treatment area marker is a plurality of LED lights disposed at said top end of said stand.

10. The set of claim 1, wherein said stand of each treatment area marker is collapsible.

11. A method of triage comprising the steps of:

establishing one or more treatment areas;

erecting a set of treatment area markers of claim 1 to indentify each treatment area, assigning a unique color to each treatment area; and lighting lamps with the assigned color on the stand to mark the area.

12. The method of claim 11, wherein the areas are designated for treating injured individuals with different injury levels and wherein assigned colors of the lamps mark the injury levels treated in the area.

13. The method of claim 12 further comprising a step of having laser lights to further mark the treatment areas.

14. The method of claim 13, further comprising a step of disposing a flag on said stand, a color of said flag matching said color of said colored light.

15. The method of claim 11, further comprising the steps of:

designating a plurality of tags identifying said treatment area; and assigning said tags individually to subjects utilizing said treatment area.

16. The method of claim 11, further comprising a step of establishing secondary areas.

17. A kit for establishing emergency medical services zones in a disaster area, said kit comprising;

a) elements to install a multitude substantially vertical stands having a bottom end and a top end; a light source assembly capable of generating different colors of light; said bottom end having a means of keeping said stand in a substantially upright position, wherein the light source assembly includes colored lights, flood lights and lasers; and b) items selected from a group consisting of a carrying case, a plurality of power sources, a plurality of reflective vests, a plurality of tags, and a means for recording and tracking said tags.

18. The kit of claim 17, wherein said kit further includes items selected from a group consisting of electronic communication devices and blankets.

19. The kit of claim 17, wherein said kit may be carried by a single average person.

* * * * *